US011952183B2

(12) United States Patent
Kuo

(10) Patent No.: US 11,952,183 B2
(45) Date of Patent: Apr. 9, 2024

(54) CUP LID FOR DISPOSABLE CUPS

(71) Applicant: Tse-Huang Kuo, Taipei (TW)

(72) Inventor: Tse-Huang Kuo, Taipei (TW)

( * ) Notice: Subject to any disclaimer, the term of this patent is extended or adjusted under 35 U.S.C. 154(b) by 0 days.

(21) Appl. No.: 17/791,888

(22) PCT Filed: Feb. 12, 2020

(86) PCT No.: PCT/CN2020/074803
§ 371 (c)(1),
(2) Date: Jul. 9, 2022

(87) PCT Pub. No.: WO2021/159288
PCT Pub. Date: Aug. 19, 2021

(65) Prior Publication Data

US 2023/0042978 A1 Feb. 9, 2023

(51) Int. Cl.
*B65D 51/16* (2006.01)
*B65D 43/02* (2006.01)

(52) U.S. Cl.
CPC ..... *B65D 51/1605* (2013.01); *B65D 43/0206* (2013.01)

(58) Field of Classification Search
CPC ..... B65D 51/1605; B65D 51/1616; B65D 51/16; B65D 43/0237; B65D 43/0206; B65D 43/0204; B65D 43/0202; B65D 43/02; B65D 2205/00; B65D 2543/00046
USPC ..... 220/802, 803, 801, 783, 780, 372, 371, 220/367.1, 713, 711
See application file for complete search history.

(56) References Cited

U.S. PATENT DOCUMENTS 6,196,409 B1 * 3/2001 Lake ..... B65D 77/225 215/261
8,056,752 B2 * 11/2011 Carnevali ..... B65D 43/0212 220/372
2003/0024930 A1 * 2/2003 Smith ..... B65D 47/141 220/254.1
2005/0067417 A1 * 3/2005 Sanders ..... B65D 45/025 220/254.1
2006/0169707 A1 * 8/2006 Walz ..... A47G 19/2272 220/780

(Continued)

FOREIGN PATENT DOCUMENTS

CN 202038551 U * 11/2011 ..... B65D 47/06
CN 205738712 U * 11/2016 ..... B65D 51/16

OTHER PUBLICATIONS

Translation of CN202038551. Chen. Nov. 16, 2011, Figs. 1 and 2 (Year: 2011).*

(Continued)

*Primary Examiner* — Robert J Hicks
(74) *Attorney, Agent, or Firm* — NZ CARR LAW OFFICE

(57) ABSTRACT

A lid for mounting on a cup opening defined by a brim of a cup body includes a cover having a substantially planar portion and a recessed opening disposed on the cover; a side wall disposed around the periphery of the cover; a flange extended from the bottom edge of the side wall and forms a trench space for accommodating the brim of the cup body when the lid is mounted on the cup opening; and a breathable film disposed below the substantially planar portion and covered the recessed opening of the cover. The cover and the breathable film of the present lid are integrally formed into a single piece.

10 Claims, 5 Drawing Sheets

(56) References Cited

U.S. PATENT DOCUMENTS

| | | | | |
|---|---|---|---|---|
| 2007/0062943 | A1* | 3/2007 | Bosworth | B65D 51/28 220/780 |
| 2007/0114236 | A1* | 5/2007 | Shiffer | B65D 43/0212 220/782 |
| 2009/0065518 | A1* | 3/2009 | Carnevali | B65D 47/06 220/711 |
| 2012/0205384 | A1* | 8/2012 | Savenok | B65D 47/06 220/592.17 |
| 2012/0272622 | A1* | 11/2012 | Weiss | B65D 43/0212 220/802 |
| 2014/0246448 | A1* | 9/2014 | Weiss | B65D 39/02 220/780 |
| 2021/0101723 | A1* | 4/2021 | Choi | B65D 51/1644 |
| 2022/0015560 | A1* | 1/2022 | Forsyth | B65D 47/265 |
| 2022/0242629 | A1* | 8/2022 | Wong | A45C 11/20 |

OTHER PUBLICATIONS

Translation of CN205738712. Han. Nov. 30, 2016, Fig. 2, Paragraph 43. (Year: 2016).*

* cited by examiner

CUP LID FOR DISPOSABLE CUPS

CROSS-REFERENCE TO RELATED APPLICATION

This application is a U.S. National Stage Filing under 35 U.S.C. 371 from International Patent Application Serial No. PCT/CN2020/074803, entitled "CUP LID," filed on Feb. 12, 2020, and published on Aug. 19, 2021, the disclosure of which is incorporated by reference herein in their entireties.

BACKGROUND OF THE INVENTION

1. Field of the Invention

The present disclosure in general relates to the field of a lid for mounting on a cup opening of a cup body. More particularly, the present disclosure relates to a lid characterized in having a breathable film disposed at a recessed cavity on the lid for dissipating steam without liquid over-spilled, leaked, or dripped from the cup.

2. Description of Related Art

Disposable containers are widely used in this modern society, especially for beverages of daily needs, such as water, coffee, and tea. Disposable containers (e.g., cups) per se are often made of materials like papers, cardboards, plastics, laminated materials and etc., but the lids for mounting on the containers are mostly made from plastics. Having the container and the lid made from different materials results in leaking or dripping due to the problem of imperfect sealing between the cup and the lid.

To address this issue, securing components are constructed on the lid to ensure the cup and the lid are tightly sealed. For example, US2009/0090721A1 (Apr. 9, 2009) described a packaging system (e.g., a disposable cup) comprising a container and a flexible overcap attached thereto, the flexible overcap includes a gasket having two surfaces respectively for sealing the container and adhering to the overcap, so that an air-tight seal between the container and the overcap may be achieved.

However, once a tight seal is formed between the cup and the lid, it creates another issue. In the case when the cup is filled with hot beverages, the pressure inside the cup immediately rise due to the rising temperature, which inevitably leads to sudden spouting of the hot liquid when the lid is opened (e.g., when a user opens the lid to drink).

To address this problem, small apertures (e.g., air holes) are created on the lid for discharging steams inside the closed space of the cup to balance the pressure inside and outside the cup. However, the inclusion of additional air holes increases the likelihood of liquid spillage and leakage, especially during transportation or delivery of drinks.

In view of the foregoing, there exists in the related art a need for an improved structure of lid, in which the lid and the cup remain air-tight seal while minimizing the likelihood of liquid being over-spilled and/or leaked from the container.

SUMMARY

The following presents a simplified summary of the disclosure in order to provide a basic understanding to the reader. This summary is not an extensive overview of the disclosure and it does not identify key/critical elements of the present invention or delineate the scope of the present invention. Its sole purpose is to present some concepts disclosed herein in a simplified form as a prelude to the more detailed description that is presented later.

As embodied and broadly described herein, the present disclosure aims to provide a lid for mounting on a cup. According to embodiments of the present disclosure, the lid has an improved structure feature that may minimize the likelihood of liquid being over-spilled and/or leaked from the cup, while maintaining the tight seal between the lid and the cup when the lid is fitted over the brim of the cup.

Accordingly, one aspect of the disclosure is directed to a lid for mounting on a cup opening defined by a brim of a cup body. The lid comprises a cover having a substantially planar portion and a recessed opening disposed on the cover; a side wall disposed around the periphery of the cover; a flange extended from the bottom edge of the side wall and forms a trench space for accommodating the brim of the cup body when the lid is mounted on the cup opening; and a breathable film disposed below the substantially planar portion and covered the recessed opening of the cover. According to the preferred embodiments, the cover and the breathable film of the present lid are integrally formed into a single piece.

According to some embodiments of the present disclosure, the side wall is characterized in having a part of the side wall forming a stepped portion above and around a part of the cover, wherein the stepped portion is disposed opposite the recessed opening.

In some embodiments of the present disclosure, the stepped portion has a drinking aperture disposed thereon.

According to a preferred embodiment, the lid further comprises a plug configured to fit into the drinking aperture.

According to certain embodiments of the present disclosure, the flange has at least one notch disposed on the bottom edge thereof; and at least one retainer protruded toward the trench space.

In some preferred embodiments, the lid further comprises a securing member, which comprises a circular frame and at least one tab, in which the circular frame is disposed within the trench space; and the tab extends downwardly from the circular frame along the outer surface of the flange and covers the notch.

According to embodiments of the present disclosure, the cover, the breathable film, and the securing member are independently made of the same or different material selected from the group consisting of acrylonitrile-butadiene styrene (ABS), cellulose ethers, ethylene-acrylic acid copolymers, poly(ether-block-amide)(PEBA), polyamide (PA), polycarbonate (PC), polyether ester (PEE), polyethylene (PE, including ultra-low density polyethylene (ULDPE) and very low density polyethylene (VLDPE)), polyethylene terephthalate (PET), polyhydroxyl ethers, polyolefins (PO), polypropylene (PP), polystyrene (PS), polystyrene-acrylonitrile (PSAN), polyurethane (PU), polyvinyl chloride (PVC), polyvinyl cyclohexane, silicone, stryrene-maleicanhydride (SMA), styrenic thermoplastic elastomer (TPS), thermoplastic polyester elastomer (TPEE), and a combination thereof. In some examples, the cover and the breathable film are independently made of polypropylene (PP); and the securing member is made of polyurethane (PU).

According to preferred embodiments of the present disclosure, the breathable film is characterized in having a plurality of micropores that are permeable to steam and gas but impervious to liquid droplets.

According to some preferred embodiments, the breathable film and the recessed opening are taken together to form a concave cavity.

By virtue of the above configuration, the thus-produced lid provides an improved structure feature—i.e., the breathable film covering the recessed opening on the cover of the lid, for balancing the gas pressure inside and outside the cup via allowing stem to dissipate therefrom, thus minimizing the likelihood of liquid being over-spilled from the container.

Many of the attendant features and advantages of the present disclosure will becomes better understood with reference to the following detailed description considered in connection with the accompanying drawings.

BRIEF DESCRIPTION OF THE DRAWINGS

The present description will be better understood from the following detailed description read in light of the accompanying drawings, where.

Figure 1:
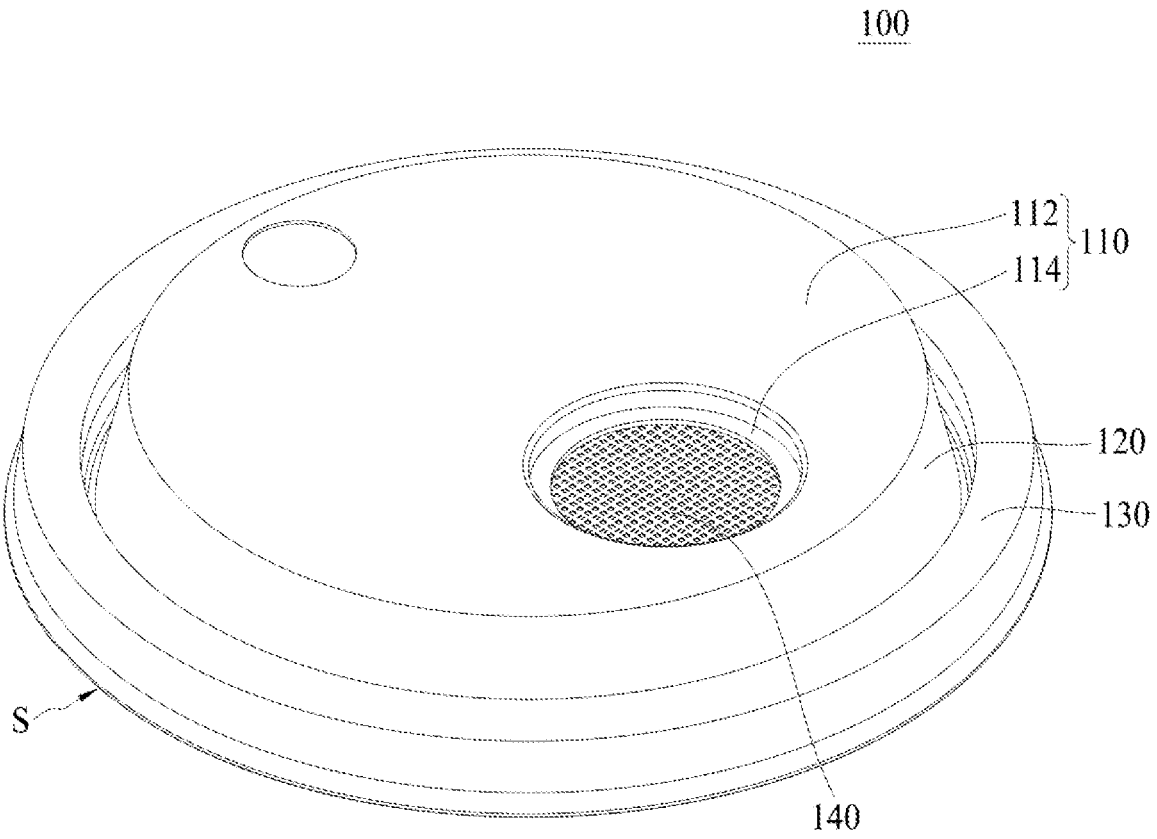
FIG. 1 is a schematic diagram illustrating a lid 100 according to one embodiment of the present disclosure.

In accordance with common practice, the various described features/elements are not drawn to scale but instead are drawn to best illustrate specific features/elements relevant to the present invention. Also, like reference numerals and designations in the various drawings are used to indicate like elements/parts.

DETAILED DESCRIPTION OF THE INVENTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

I. Definition

For convenience, certain terms employed in the specification, examples and appended claims are collected here. Unless otherwise defined herein, scientific and technical terminologies employed in the present disclosure shall have the meanings that are commonly understood and used by one of ordinary skill in the art. Also, unless otherwise required by context, it will be understood that singular terms shall include plural forms of the same and plural terms shall include the singular. Specifically, as used herein and in the claims, the singular forms "a" and "an" include the plural reference unless the context clearly indicates otherwise. Also, as used herein and in the claims, the terms "at least one" and "one or more" have the same meaning and include one, two, three, or more.

Throughout the present disclosure, the term "container" is intended to include any article, receptacle, or vessel utilized for storing, dispensing, packaging, or portioning items. Examples of the container include, but are not limited to, a cup, jar, bottle, bowl, plate, carton, case, crate, dish, or other types of holders. The term "disposable container" as used in this specification refers to a container that has the characteristics typically associated with disposable materials. However, the use of the term "disposable" does not mean that the container must necessarily only be a single-use container and that it be discarded after only one use. According to certain embodiments of the present disclosure, the container is used to hold beverages, especially hot drinks.

Throughout the present disclosure, the "lid" is made by injection molding techniques well-known in the art. The term "injection molding" refers broadly to any technique for injecting one or more materials (i.e., injectant) into a mold to produce an article with the desired shape or configuration. Non-limiting examples of the material suitable to be used as the injectant include thermoplastic polymer, thermosetting polymer, elastomer, light-curing polymer, metal, glass, and ceramic.

II. Description of the Invention

The present disclosure aims to provide an improved lid for use with a disposable container, in which the lid has a unique design that allows steam or hot air to leave the container thereby minimizes the likelihood of subsequent sudden spouting of the liquid from the container.

Accordingly, the objective of the present disclosure is directed to a lid characterizing in having a breathable film integrally formed therein for discharging air when the lid is fitted over the brim of the container.

As could be appreciated, the present container may be a cup, which has a cup opening defined by a brim of a cup body for containing beverages, and the lid is mounted on the brim to cover the cup opening.

According to various embodiments of the present disclosure, the present lid is intended to be fitted over the brim of the cup to cover the opening of the cup, and prevent the content held in the cup from coming out of the cup easily, and accordingly, the flange of the lid should substantially match the brim of the cup so as to tightly held the cup in place.

Reference is now made to FIG. 1, which illustrates a lid 100 according to one aspect of the present disclosure. The lid 100 comprises in its structure, a cover 110 having a substantially planar portion 112 and a recessed opening 114, a side wall 120 disposed around the periphery of the cover 110, a flange 130 extended from the bottom edge of the side wall 120 and forms a trench space S, and a breathable film 140 covering the recessed opening 114.

As depicted, the recessed opening 114 is disposed near the edge of the cover 110, and is recessed below the surface of the substantially planar portion 112. However, it should be noted that the recessed opening 114 may be disposed at any location on the cover 110. The breathable film 140 is disposed below the substantially planar portion 112 and covered the recessed opening 114. Preferably, the breathable film 140 is integrally formed with the cover 110 into a single piece. Alternatively or optionally, the breathable film 140 and the cover 110 may be independently formed and then bind together (e.g., by use of an adhesive).

According to embodiments of the present disclosure, the lid 100 is made by injection molding. Injection molding is a manufacturing process, in which an injectant, mostly a polymer, is heated until it becomes pliable, and then injected into the cavity of a mold, where it cools and hardens into the configuration of the cavity. Examples of injectant suitable for manufacturing the lid 100 of the present disclosure include, but are not limited to, acrylonitrile-butadiene styrene (ABS), cellulose ethers, ethylene—acrylic acid copolymers, poly(ether-block-amide)(PEBA), polyamide (PA), polycarbonate (PC), polyether ester (PEE), polyethylene (PE, including ultra-low density polyethylene (ULDPE) and very low density polyethylene (VLDPE)), polyethylene terephthalate (PET), polyhydroxyl ethers, polyolefins (PO), polypropylene (PP), polystyrene (PS), polystyrene-acrylonitrile (PSAN), polyurethane (PU), polyvinyl chloride (PVC), polyvinyl cyclohexane, silicone, stryrene-maleicanhydride (SMA), styrenic thermoplastic elastomer (TPS), thermoplastic polyester elastomer (TPEE), and a combination thereof.

According to some embodiments of the present disclosure, at least one injectant is used to form the present lid 100 by injection molding, in which the cover 110, the side wall 120, the flange 130, and the breathable film 140 are integrally formed into one piece. Further, the cover 110 and the breathable film 140 may be independently formed from the same or different injectants. In the case when two injectants are used in injection molding, both injectants may be injected simultaneously or sequentially according to well-known processes. In some embodiments, the cover is formed by a first injectant such as PP; while the breathable film is formed by a second injectant such as PE. In embodiments where two injectants are used, at least one of them is a food grade material. Alternatively or optionally, at least one of the injectants is a biodegradable material. In other embodiments, only one injectant (e.g., PP or PE) is used to form the present lid 100. In some examples, PP is used to form both the cover 110 and the breathable film 140 into the lid 100. In other examples, PE is used to form both the cover 110 and the breathable film 140 into the lid 100.

Preferably, the breathable film 140 is formed by latitude and longitude threads of an injectant (e.g., wefts and warps of PP, or wefts and warps of PE) woven together, thereby forming a film having micropores that are permeable to steams and gases, but impervious to droplets of a liquid. In other words, the steam of a hot beverage, but not beverage in the form of liquid droplets, may escape from the micropores of the breathable film. By this manner, the pressure inside and outside the cup comes to an equilibrium, thereby reducing the likelihood of sudden spouting of the beverage from the cup when drinking or during transporting.

References are now made to FIGS. 2A, 2B, 3, and 4, which are directed to a lid 200 in accordance with another aspect of the present disclosure. Similar to the lid 100 described above, the lid 200 in this embodiment also comprises in its structure, a cover 210, a side wall 220, a flange 230 and a breathable film 240; and the cover 210 also has a substantially planar portion 212 and a recessed opening 214, in which the bottom of the recessed opening 214 is covered by the breathable film 240. Preferably, the cover 210 and the breathable film 240 are integrally formed into a single piece (see FIGS. 2 and 3). As better illustrated in the cross-sectional view in FIG. 3, the edge of the recessed opening 214 transits into the breathable film 240 smoothly, without any gap or crevice therebetween; allowing the recessed opening 214 and the breathable film 240 to be taken together and form a concave cavity (denoted as "C"), in which stem (but not liquid droplets) of a hot beverage may be dissipated from the film 240 and accumulated in the concave cavity C in the form of water drops upon contacting the relatively cooler air outside the cup.

Figure 2A:
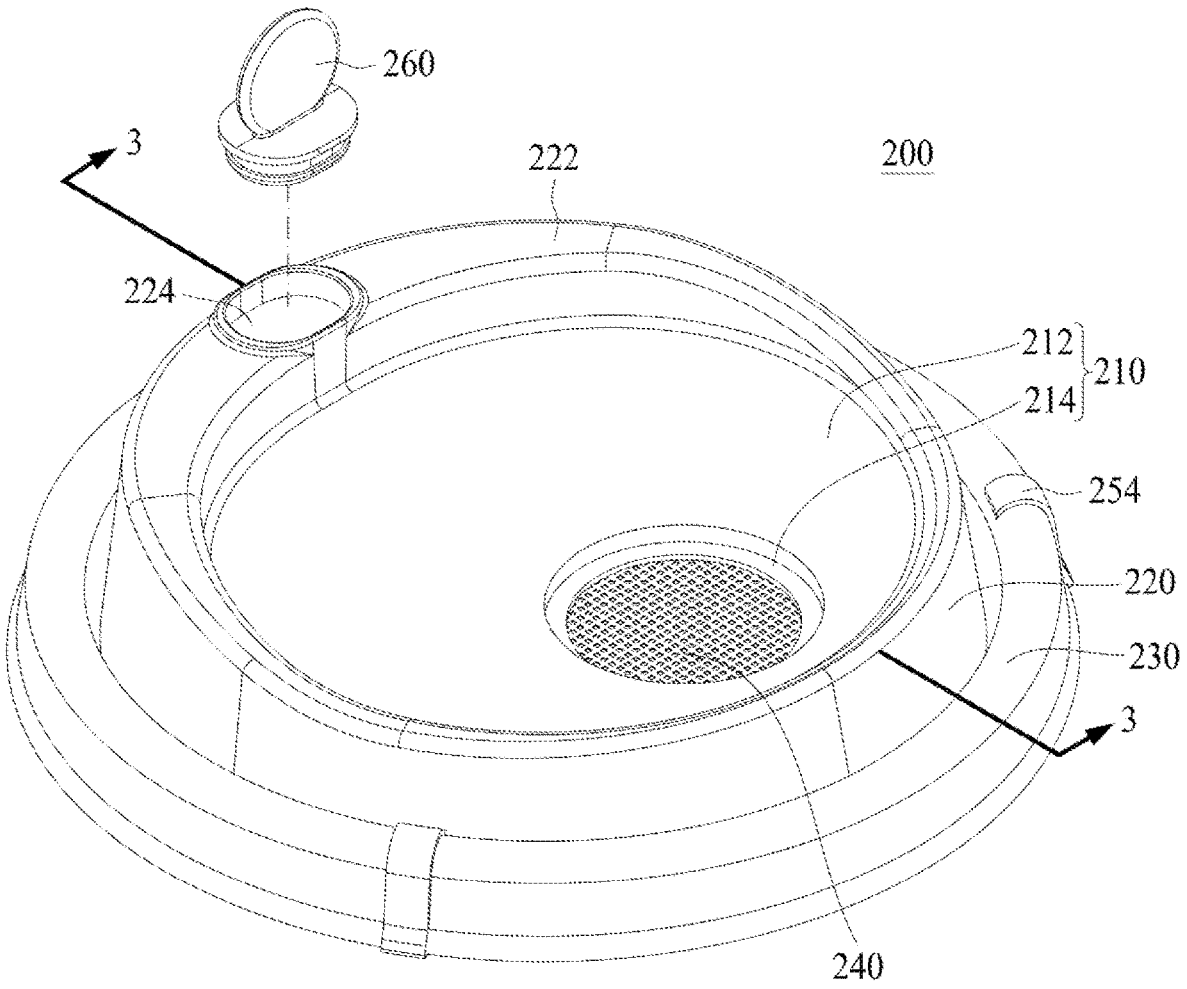
FIGS. 2A and 2B are schematic diagrams respectively illustrating the top-front view (FIG. 2A) and the bottom view (FIG. 2B) of a lid 200 according to another embodiment of the present disclosure.

Further, as depicted in FIG. 2A, the side wall 220 of the lid 200 has a stepped portion 222 that is formed above and around a part of the cover 210. Preferably, the stepped portion 222 is disposed opposite the recessed opening 214 (i.e., away from the recessed opening 214); and a drinking aperture 224 is constructed and disposed on the step portion 222, allowing the user to sip or drink therefrom. In addition, having the drinking aperture 224 disposed at a position away from the recessed opening 214 may also reduce the likelihood of any liquid blocking or plugging the breathable film 240 when the cup is tilted (i.e., when the user drinks). Additionally or optionally, an additional plug 260 may be inserted into the drinking aperture 224 to prevent liquid from spilling out of the cup from the drinking aperture 224. The plug 260 suitable for use in the present disclosure is not limited to certain sizes and/or shapes, as long as it conforms with the configuration of the drinking aperture 224 and forms a tight sealing when inserted therein.

Figure 2B:
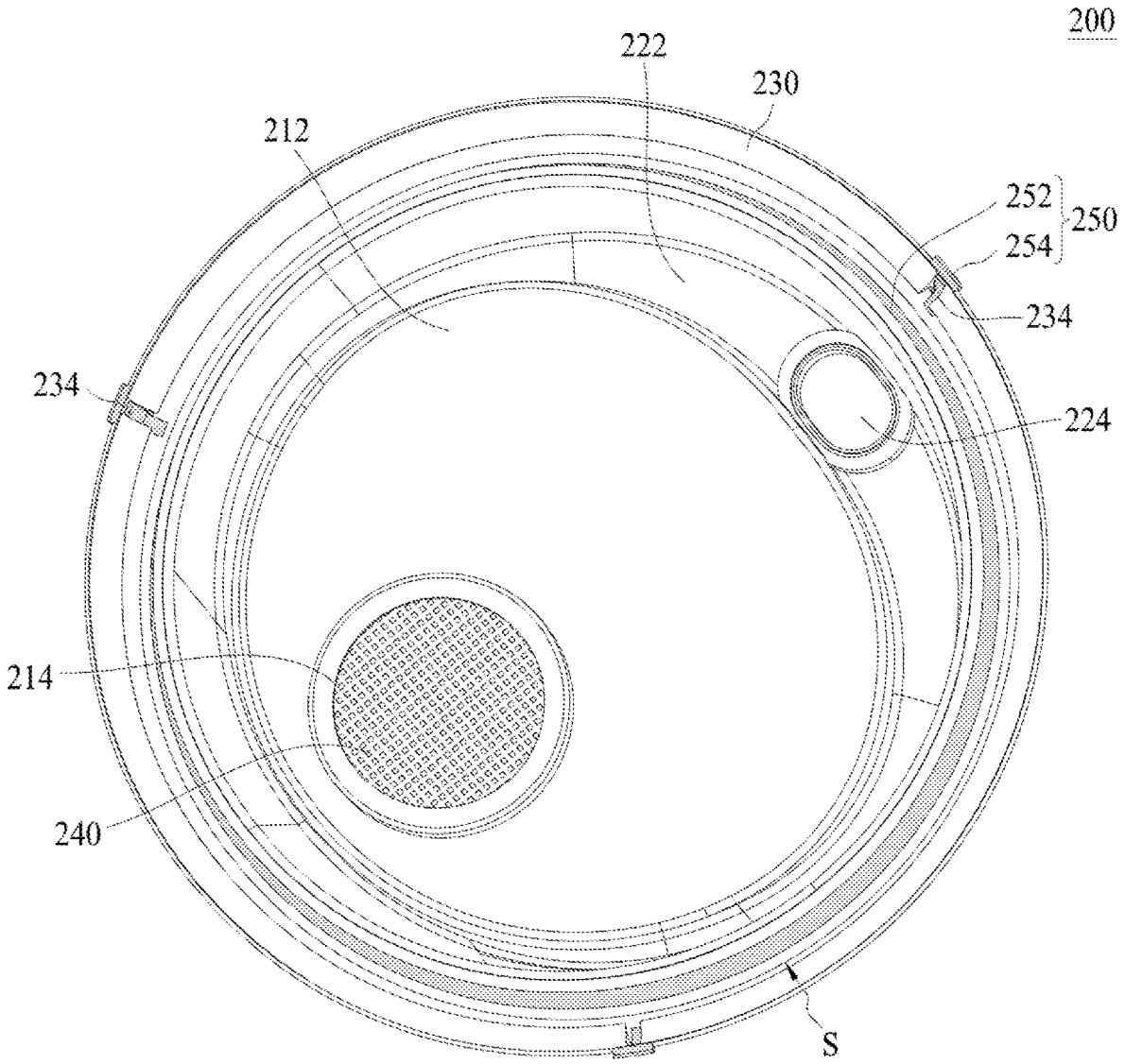
Figure 3:
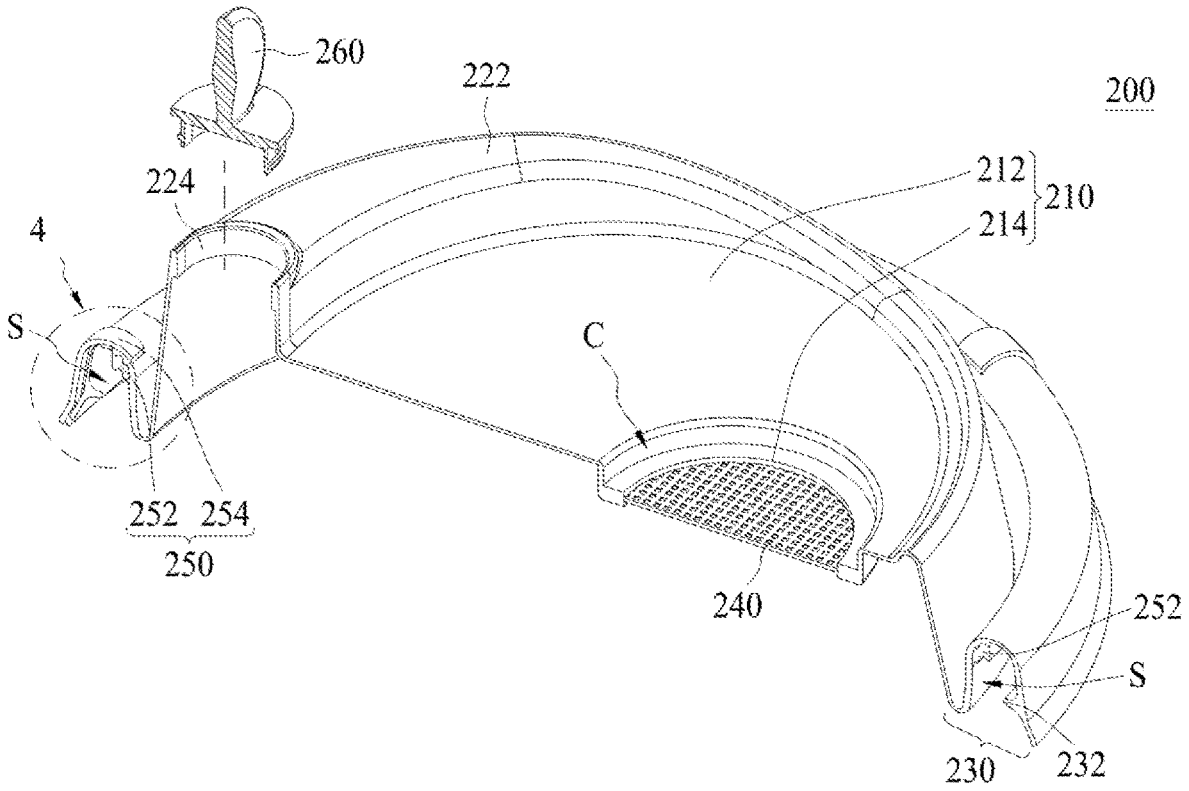
FIG. 3 is a cross-sectional view of the lid 200 along line 3-3 in FIG. 2A.
Figure 4:
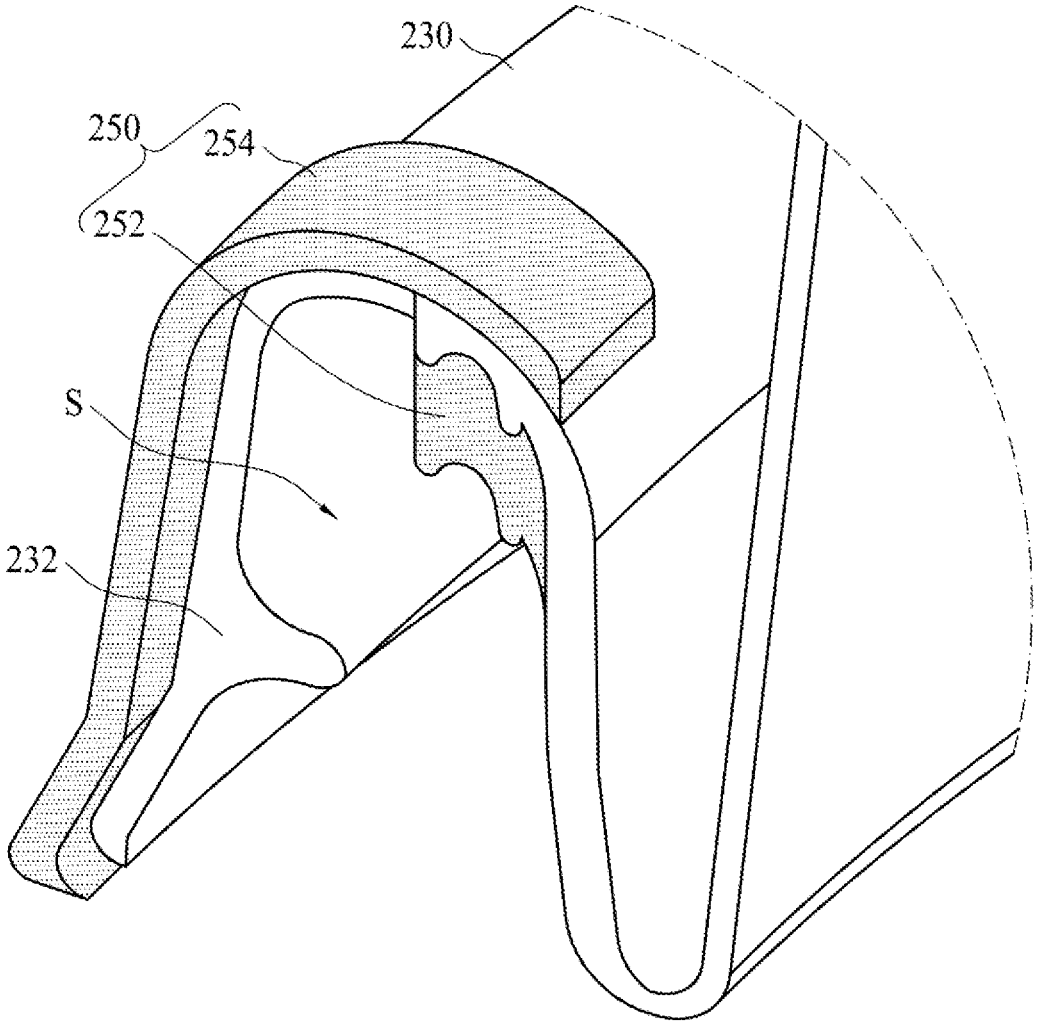
FIG. 4 is an enlarged view of a portion of the lid 200 circled in FIG. 3 in accordance with another embodiment of the present disclosure.

References are now made to FIGS. 2B, 3 and 4, particularly to the trench space S, which is defined by two side walls of the flange 230 forming a U-shaped space, where the brim of the cup (not shown) can be tightly held in that space when the lid 200 is mounted to the brim of the cup. To ensure a tight seal may be formed between the cup and the lid 200, the flange 230 is designed to comprises at least one notch 234 at its bottom edge (see FIG. 2B), and a retainer 232 protruded inwardly towards the trench space S (see FIGS. 3 and 4). Both the notch 234 and the protruded retainer 232 serve the purpose for holding the brim of the cup in place, when the lid 200 is fitted over the brim of the cup.

In addition, the flange 230 further comprise a securing member 250 to help securing the lid 200 with the cup. As depicted in the enlarged view of FIG. 4, the securing member 250 comprises a circular frame 252 and at least one tab 254. The circular frame 252 is substantially a ring shape and disposed within the trench space S, or on the inner surface of the lid 200 that faces the cup opening. When the lid 200 is mounted onto the cup opening, the circular frame 252 would be attached to the brim and at least a portion of the cup body; at the same time, the tab 254 would extend downwardly from the circular frame 252 along the outer surface of the flange 230 to cover the notch 234 of the flange 230. The tab 254 also serves the purpose of preventing the lid 200 being slit from the notch 234, thereby improving the structural integrity of the lid 200. Accordingly, the tab 254 is preferably no shorter than the width of the bottom opening of the notch 234, such that the lower edge of the tab 254 is disposed across the bottom of the notch 234. The tab 254 can be formed as a flat piece or a frame, and has a shape that matches that of the notch 234. Alternatively or additionally, the tab 254 may also serves the purpose of holding the circular frame 252 onto the lid 200 thereby attains a secure engagement between the lid 200 and the cup, thus, each tab 254 extends from the circular frame 252 and downwardly into the flange 230 along its outer surface (i.e., the surface facing outside) and completely covers the notch 234, such that the securing member 250 is fastened with the flange 230 and the lid 200. Preferably, the number of the notch 234 is equal to the number of the tab 254, for example, the number can be 1, 2, 3, 4, 5, 6, 7, 8, 9, or 10, but not limited thereto. In one preferred embodiment, there are respectively three tabs 254 and three notches 234 (see FIG. 2B).

In some embodiments, the securing member 250 is made of a material that is same or different from the injectant material forming the cover 210. Further, the securing member 250 can also be manufactured by the same injection molding process described above. Additionally or alternatively, the securing member 250 and the cover 210 can be integrally formed into a single piece or separately formed as two independent pieces. In some embodiment, the securing member 250 is made of PU, while the cover 210 is made of PP or PE.

In view of the foregoing, the lid of the present disclosure is advantageous in having the structure feature of a breathable film disposed below the substantially planar portion of the cover for dissipating steam while preventing liquid droplets from over-spilling from the cup. Further, the breathable film and the cover of the lid are integrally formed into a single piece by injection molding. In conclusion, the present disclosure provides a lid that is inexpensive to produce, and yet could reduce the likelihood of over-spilled liquid while enhancing sealing between the lid and the cup.

It will be understood that the above description of embodiments is given by way of example only and that various modifications may be made by those with ordinary skill in the art. The above specification, examples and data provide a complete description of the structure and use of exemplary embodiments of the invention. Although various embodiments of the invention have been described above with a certain degree of particularity, or with reference to one or more individual embodiments, those with ordinary skill in the art could make numerous alterations to the disclosed embodiments without departing from the spirit or scope of this invention.

What is claimed is:

1. A lid for mounting on a cup opening defined by a brim of a cup body, wherein the lid comprises, a cover having a substantially planar portion and a recessed opening disposed on the cover;

a side wall disposed around the periphery of the cover;

a flange extended from the bottom edge of the side wall and forms a trench space for accommodating the brim of the cup body when the lid is mounted on the cup opening; and a breathable film disposed below the substantially planar portion and covered the recessed opening of the cover;

wherein, the cover and the breathable film are integrally formed into a single piece, and an edge of the recessed opening transitions into the breathable film smoothly without any gap or crevice therebetween.

2. The lid of claim 1, wherein the side wall is characterized in having a part of the side wall forming a stepped portion above and around a part of the cover, wherein the stepped portion is disposed opposite the recessed opening.

3. The lid of claim 2, wherein the stepped portion has a drinking aperture disposed thereon.

4. The lid of claim 3, further comprising a plug configured to fit into the drinking aperture.

5. The lid of claim 1, wherein the flange has at least one retainer protruded inwardly toward the trench space; and the flange has at least one notch disposed on the bottom edge thereof.

6. The lid of claim 5, further comprising a securing member, which comprises a circular frame and at least one tab, wherein the circular frame is disposed within the trench space; and the tab extends downwardly from the circular frame along the outer surface of the flange and covers the notch.

7. The lid of claim 6, wherein the cover, the breathable film, or the securing member is made of a material selected form the group consisting of acrylonitrile-butadiene styrene (ABS), cellulose ethers, ethylene-acrylic acid copolymers, poly(ether-block-amide)(PEBA), polyamide (PA), polycarbonate (PC), polyether ester (PEE), polyethylene (PE, including ultra-low density polyethylene (ULDPE) and very low density polyethylene (VLDPE)), polyethylene terephthalate (PET), polyhydroxyl ethers, polyolefins (PO), polypropylene (PP), polystyrene (PS), polystyrene-acrylonitrile (PSAN), polyurethane (PU), polyvinyl chloride (PVC), polyvinyl cyclohexane, silicone, stryrene-maleicanhydride (SMA), styrenic thermoplastic elastomer (TPS), thermoplastic polyester elastomer (TPEE), and a combination thereof.

8. The lid of claim 7, wherein the cover and the breathable film are made of polypropylene (PP), and the securing member is made of polyurethane (PU).

9. The lid of claim 1, wherein the breathable film is characterized in having a plurality of micropores, which are permeable to steams and gases but impervious to liquid droplets.

10. The lid of claim 1, wherein the breathable film and the recessed opening are taken together to form a concave cavity.

* * * * *